US010914295B2

(12) United States Patent
De Cesare et al.

(10) Patent No.: US 10,914,295 B2
(45) Date of Patent: Feb. 9, 2021

(54) PISTON PUMP AND RELATIVE CONTROL METHOD

(71) Applicant: MARELLI EUROPE S.p.A., Corbetta (IT)

(72) Inventors: Matteo De Cesare, Torremaggiore (IT); Nicola Torcolini, Bologna (IT)

(73) Assignee: MARELLI EUROPE S.p.A., Corbetta (IT)

( * ) Notice: Subject to any disclaimer, the term of this patent is extended or adjusted under 35 U.S.C. 154(b) by 0 days.

(21) Appl. No.: 16/368,958

(22) Filed: Mar. 29, 2019

(65) Prior Publication Data

US 2019/0301438 A1 Oct. 3, 2019

(30) Foreign Application Priority Data

Mar. 29, 2018 (IT) ..... 102018000004099

(51) Int. Cl.
*F04B 7/00* (2006.01)
*F04B 49/22* (2006.01)
(Continued)

(52) U.S. Cl.
CPC ..... *F04B 7/0076* (2013.01); *F04B 17/044* (2013.01); *F04B 49/03* (2013.01);
(Continued)

(58) Field of Classification Search
CPC ..... F04B 7/0076; F04B 49/03; F04B 49/06; F04B 17/04; F04B 17/042; F04B 17/044; F04B 2203/022; F04B 49/22
(Continued)

(56) References Cited

U.S. PATENT DOCUMENTS

2011/0020159 A1 1/2011 Kuttler et al.
2014/0158205 A1* 6/2014 Tanabe ..... F04B 7/0076 137/1
(Continued)

FOREIGN PATENT DOCUMENTS

DE 19532037 C1 12/1996
DE 102014222463 A1 5/2016
(Continued)

OTHER PUBLICATIONS

Machine Translation of WO-2008026661, 'W02080026661A_MT_JP.pdf', Mar. 2008.*
(Continued)

*Primary Examiner* — Kenneth J Hansen
(74) *Attorney, Agent, or Firm* — Howard & Howard Attorneys PLLC

(57) ABSTRACT

A piston pump for feeding a liquid in a vehicle having at least one piston, which is configured to cyclically slide inside a housing between a top dead centre and a bottom dead centre. The liquid is usually fed along a main feeding direction from a suction duct to a delivery duct. The piston pump has two solenoid valves, which are each arranged in the suction duct and in the delivery duct, respectively, and are designed to be operated by an electronic control unit so as to reverse the liquid feeding direction from the main feeding direction to a secondary feeding direction opposite the main liquid feeding direction and/or so as to adjust the cylinder capacity of the piston pump. The piston is operated by an electromechanical actuator, in particular comprising an electromagnet.

14 Claims, 5 Drawing Sheets

(51) Int. Cl.
*F04B 49/03* (2006.01)
*F04B 17/04* (2006.01)

(52) U.S. Cl.
CPC ..... *F04B 49/22* (2013.01); *F04B 2201/0201* (2013.01); *F04B 2203/0401* (2013.01)

(58) Field of Classification Search
USPC ..... 417/322
See application file for complete search history.

(56) References Cited

U.S. PATENT DOCUMENTS

| | | | |
|---|---|---|---|
| 2015/0204286 | A1 | 7/2015 | Prodi et al. |
| 2018/0328303 | A1 | 11/2018 | De Cesare et al. |

FOREIGN PATENT DOCUMENTS

| | | | | | |
|---|---|---|---|---|---|
| GB | 26557 | A | | 9/1911 | |
| GB | 2490180 | A | * | 10/2012 | ..... F04B 17/00 |
| GB | 2490180 | A | | 10/2012 | |
| WO | 2008026661 | A1 | | 3/2008 | |
| WO | WO-2008026661 | A1 | * | 3/2008 | ..... F04B 17/044 |

OTHER PUBLICATIONS

Search Report for Italian Patent Application No. 201800004099 dated Sep. 18, 2018.
Italian Patent Application No. BO2014A000023 filed Jan. 21, 2014 and available for inspection on Jul. 21, 2015.
Italian Patent Application No. 102017000050454 filed May 10, 2017 and available for inspection on Nov. 10, 2018.

* cited by examiner

PISTON PUMP AND RELATIVE CONTROL METHOD

CROSS-REFERENCE TO RELATED APPLICATIONS

This patent application claims priority from Italian patent application no. 102018000004099 filed on Mar. 29, 2018, the entire disclosure of which is incorporated herein by reference.

BACKGROUND OF THE INVENTION

1. Field of the Invention

The invention relates to a piston pump and to a relative control method.

2. Description of the Related Art

The invention finds advantageous application in internal combustion engines, where a liquid (for example, fuel or a cooling liquid or a water-based cleaning liquid) is fed through a pump. It is well-known that a pump feeds the liquid coming from a tank to a delivery pipe, which ends in at least one using device.

During the use, the need can arise to remove the liquid previously fed to the delivery pipe arranged downstream of the pump.

Patent application DE102014222463A1 discloses different methods to feed liquid (in particular, water) into a delivery duct or, alternatively, remove it from there. In order to remove water from the delivery duct, the aforesaid patent application suggests the use of bypass ducts or of slide valves, which, depending on how they are operated, allow water to be fed or removed. In all the embodiments described therein, the pump always works in the same operating direction (in order to feed or remove water) and a complicated and large-sized system is requested to establish a communication between the delivery and the suction, which is needed to remove water from the delivery duct.

Patent application IT102017000050454 discloses how to control a linear actuator in a closed loop by means of a microphone actuator. The technical teaches thereof could be applied to a piston pump. However, the system described therein does not allow users to adjust the flow rate and reverse the piston pump. On the other hand, patent application ITBO2014A000023 discloses how to adjust the flow rate of a feeding pump, for example by means of an adjustment device, maintaining the same operating direction. However, the adjustment device described therein cannot be applied to a piston pump, since this would lead to too high pressure oscillations ("ripples").

Therefore, to sum up, external devices for the removal of the liquid from the delivery duct are very large and difficult to be manufactured; whereas flow rate adjustment devices cannot usually be applied to piston pumps because they cause very high pressure oscillations ("ripples").

On the other hand, US2011020159A1 discloses a piston pump, which is mechanically operated by means of a cam and allows the liquid feeding direction to be reversed and the cylinder capacity of the piston pump to be adjusted. The piston pump described therein comprises a common pre-chamber, which is fluidically connected to a work chamber so that the fluid flows from a delivery valve to the work chamber and, subsequently, from the work chamber towards the fluid return valve. This piston pump evidently requires a large number of elements and, therefore, is hard and expensive to be manufactured and, furthermore, turns out to be large-sized.

DESCRIPTION OF THE INVENTION

Therefore, the object of the invention is to provide a piston pump and a relative control method which are not affected by the drawbacks of the prior art and, at the same time, are easy and economical to be manufactured and implemented.

According to the invention, there are provided a piston pump and a relative control method according to the appended claims.

BRIEF DESCRIPTION OF THE DRAWINGS

The invention will now be described with reference to the accompanying drawings, showing a non-limiting embodiment thereof, wherein.

PREFERRED EMBODIMENTS OF THE INVENTION

Figure 1:
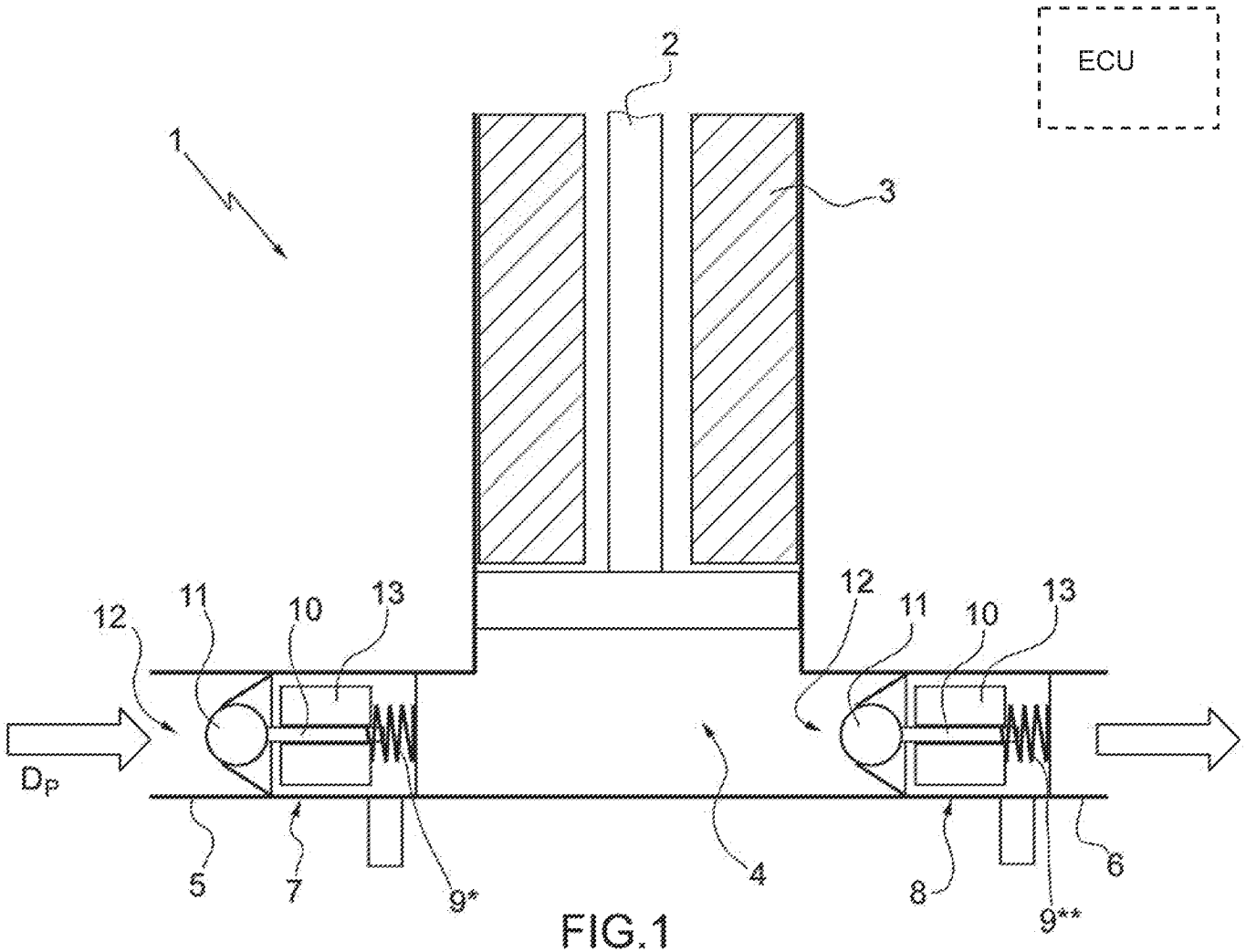
FIG. 1 is a schematic view of a piston pump according to the invention, which is operated so as to pump the liquid in a main feeding direction.

In FIG. 1, number 1 indicates, as a whole, a piston pump.

The piston pump 1 described herein does not have one single application possibility, but can be used for any application inside a vehicle and with any liquid. The liquid can be fuel, cooling or cleaning water, oil or any other type of liquid used inside the vehicle.

The piston pump 1 comprises a piston 2, which is configured to cyclically slide inside a housing 3 between a top dead centre PMS and a bottom dead centre PMI. In other words, the piston 2 cyclically moves inside the housing 3 so as to cover a suction stroke or a delivery stroke. In particular, in the suction stroke, which takes place during the suction phase of the piston pump 1, the piston 2 moves from its bottom dead centre PMI towards its top dead centre PMS; whereas, in the delivery stroke, which takes place during the delivery phase of the piston pump 1, the piston 2 moves from its top dead centre PMS towards its bottom dead centre PMI.

Figure 2:
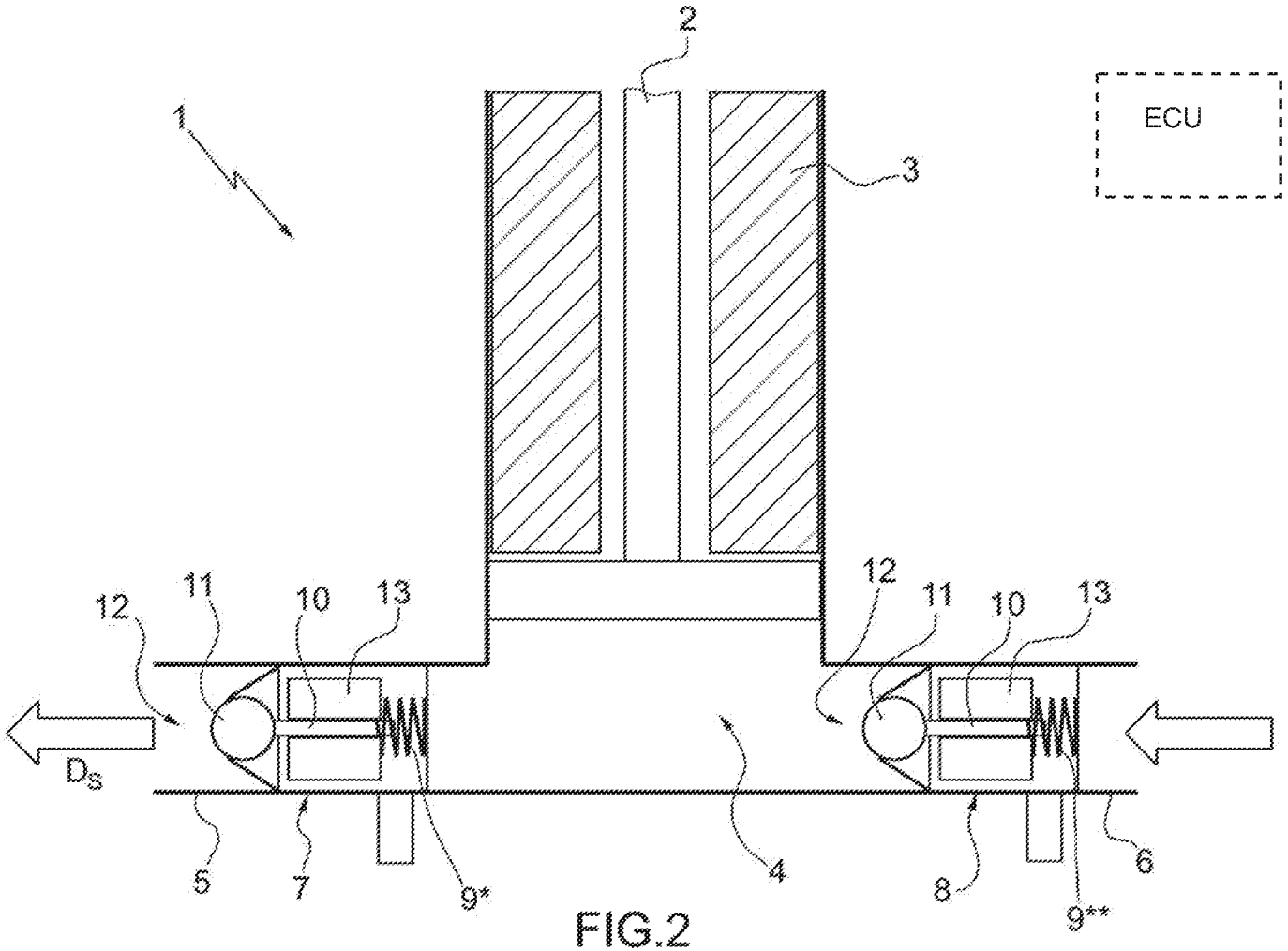
FIG. 2 is a schematic view of the piston pump of FIG. 1, which is operated to as to pump the liquid in a secondary feeding direction, which is opposite the main feeding direction.

According to FIGS. 1 and 2, under the bottom dead centre PMI there is a dead volume 4, which is interposed between a suction duct 5 and a delivery duct 6 of the piston pump 1. In particular, the dead volume 4 is laterally delimited by two solenoid valves 7 (arranged in the area of the suction duct 5) and 8 (arranged in the area of the delivery duct 6), respectively. The fact that the valves 7 and 8 are solenoid valves allows them to be operated in a precise and accurate manner.

The suction duct 5 is configured to receive the liquid coming from a tank (not shown) and fed to the piston pump 1 by means of a liquid suction circuit; whereas the delivery duct 6 is configured to receive the fluid processed by the piston pump 1 so as to send it, through a liquid delivery duct, to at least one user (not shown).

Through the operation of the suction solenoid valve 7 and/or of the delivery solenoid valve 8 it is possible to reverse the liquid feeding direction (in particular, from a main feeding direction $D_P$ to a secondary feeding direction $D_S$ and vice versa) and/or it is possible to adjust the cylinder capacity V of the piston pump 1 and, hence, the flow rate Q processed by the piston pump 1. In other words, the operation of the solenoid valves 7 and 8 allows users to obtain a reversible piston pump 1 and/or a piston pump 1 with a variable cylinder capacity V.

In order to allow the piston pump 1 to be reversible, the solenoid valves 7 and 8 are controlled independently of one another. In other words, in order to allow the piston pump 1 to be reversible, the solenoid valves 7 and 8 are opened or closed, as described more in detail below, depending on whether the piston 2 is covering the suction stroke or the delivery stroke. As a consequence, the liquid feeding direction and, hence, the operating direction of the piston pump 1 can be reversed without the addition of reversing devices on the outside of the piston pump 1. Therefore, the liquid can flow in the main liquid feeding direction $D_P$, as shown in FIG. 1, or in the secondary feeding direction $D_S$, which is opposite the main feeding direction $D_P$, as shown in FIG. 2.

Hence, by reversing the liquid feeding direction, the operating direction of the piston pump 1 is reversed as well, thus causing the piston pump 1 to become reversible. The reversal of the liquid feeding direction and, hence, of the operating direction of the piston pump 1, leads to the emptying of the delivery duct 6 downstream of the delivery solenoid valve 8. In other words, the operating direction of the piston pump 1 is usually reversed to empty the delivery duct 6 downstream of the delivery solenoid valve 8, which, in this case, acts as a liquid suction valve.

Owing to the above, it is evident that the liquid feeding direction and the operating direction of the piston pump 1 are correlated with one another.

FIG. 1 shows the piston pump 1 operating in the main liquid feeding direction $D_P$. In this case, the liquid coming from the tank, at first, flows through the solenoid valve 7, thus entering the dead volume 4, and, subsequently, when the delivery solenoid valve 8 is opened, is pumped (pushed) downstream of the latter by the action of the piston 2 covering the delivery stroke.

During the suction phase, the piston 2 moves towards the top dead centre PMS (namely, it covers the suction stroke) and the suction solenoid valve 7 is controlled so as to open and let the liquid fill the dead volume 4. After having reached the top dead centre PMS, the suction solenoid valve 7 is closed, whereas the delivery solenoid valve 8 is opened and the piston 2 moves towards the bottom dead centre PMI (namely, it covers the delivery stroke).

By reversing the fluid feeding direction and, hence, the operating direction of the piston pump 1, according to FIG. 2, the operation of the solenoid valves 7 and 8 is reversed as well. In other words, the delivery solenoid valve 8 regulates the flow of liquid into the dead volume 4 and, hence, acts like a suction valve; whereas the suction solenoid valve 7 regulates the flow of liquid out of the dead volume 4 and, hence, acts like a delivery valve. Compared to the operating mode described above in relation to FIG. 1, in the reverse operating mode shown in FIG. 2 the only difference lies in the strategy used to control the solenoid valves 7 and 8.

In this case, namely during the emptying of the delivery duct 6, the cylinder capacity of the piston pump 1 could also not need to be variable.

According to FIGS. 1 and 2, the suction solenoid valve 7 and the delivery solenoid valve 8 each comprise a spring 9, which acts through a rod 10 upon a closing element 11, which at least partially engages or disengages a passage port 12 of the solenoid valve 7 or 8, so as to allow the liquid to flow through the passage port 12 of the solenoid valve 7 or 8 or prevent it from doing so. The closing element 11 can be, for example, a ball or a plate. According to FIGS. 1 and 2, the movement of each rod 10 is controlled by a corresponding electromagnet 13. In other words, the opening and/or closing of the solenoid valve 7 or 8 is controlled by the electromagnet 13.

The springs 9 of the solenoid valves 7 or 8 need to be pre-loaded. The pre-load of the spring 9* of the suction solenoid valve 7 preferably is different from the pre-load of the spring 9 of the delivery solenoid valve 8**.

In particular, the spring 9* of the suction solenoid valve 7 has a pre-load value such that the closing element 11 keeps the passage port 12 closed when the piston 2 moves from the bottom dead centre PMI to the top dead centre PMS; whereas the delivery solenoid valve 8 has a pre-load value such that the closing element 11 keeps the passage port 12 of the delivery solenoid valve 8 closed when the piston moves from the top dead centre PMS to the bottom dead centre PMI.

The different pre-load of the springs 9 arranged in the suction solenoid valve 7 and in the delivery solenoid valve 8, respectively, is necessary when the piston pump 1 feeds the liquid in the secondary liquid feeding direction $D_S$.

If the pre-load of the spring 9* of the suction solenoid valve 7 were too low, during the operation with reversed direction, the suction solenoid valve 7 would risk being accidentally opened, even though only partially, when the delivery solenoid valve 8 is opened to cause the liquid to be removed from the delivery duct 6. In this case, besides sucking the liquid from the delivery duct 6, part of the liquid would also be sucked from the tank arranged upstream of the suction solenoid valve 7. This would lead to more time needed to empty the delivery duct 6.

If, on the other hand, the pre-load of the spring 9 of the delivery solenoid valve 8 were too low, the delivery solenoid valve 8 would risk being accidentally opened when the suction solenoid valve 7 is activated in order to remove the liquid from the delivery duct 6 and send it to the tank. In this way, part of the liquid removed from the delivery duct 6 would return to the latter. This would cause, again, more time needed to empty the delivery duct 6**.

In order to allow the delivery circuit to be emptied when the liquid is under pressure, the suction solenoid valve 7 and the delivery solenoid valve 8 are both opened simultaneously, so as to allow the liquid to flow back into the tank, until the pressure inside the delivery duct reaches the value of the ambient pressure.

For some applications this type of emptying of the delivery duct could be enough. For other applications, instead, the delivery duct needs to be completely drained, since problems could arise if some liquid remained in the circuit, for example with external temperatures below 0°. In the case, indeed, the liquid contained in the delivery circuit could freeze and damage the components forming the delivery circuit and the piston pump 1.

In order to completely empty the circuit, the control of the solenoid valves 7 and 8 needs to be reversed based on the movement of the piston 2, as described above. In addition, when the pressure gets close to the atmospheric pressure, it is necessary to open an injector (not shown) or a valve (not shown), which is placed at the end of the liquid delivery circuit. The opening of the injector or valve placed at the end of the delivery circuit is needed to completely empty the circuit and to prevent the latter from being subjected to a depression. If the injector or valve were not opened, some liquid could remain inside the circuit at a pressure which is the same as the atmospheric pressure, which could cause damages to the liquid delivery system, if the temperature dropped to values below the liquid solidification values. The duration of the operation of the piston pump 1 in the secondary feeding direction Ds depends on the dimensions of the liquid delivery circuit to be emptied.

As already mentioned above, through the operation of the suction solenoid valve 7 and of the delivery solenoid valve 8 it is possible to adjust, alternatively or in addition, the flow rate Q processed by the piston pump 1, so as to have a piston pump 1 with a variable cylinder capacity V. In other words, depending on how the solenoid valves 7 and 8 are operated, the quantity of liquid processed by the piston pump 1 can change, so as to pump more or less liquid, taking into account the requested amount, into the delivery pipe.

As it is well-known, the flow rate Q delivered by the piston pump 1 can be evaluated based on the following formula:

$$Q=\eta*V*f$$

wherein:

η is the volume efficiency of the piston pump 1;

V is the cylinder capacity of the piston pump 1; and f is the frequency of actuation of the piston 2, which is operated by an actuator (not shown), which can be an electromechanical or mechanical actuator (usually a cam), as described more in detail below.

As a consequence, the flow rate Q delivered by the piston pump 1 can be adjusted by changing the frequency f of actuation of the piston 2 or by changing the cylinder capacity V of the piston pump 1.

The frequency f can be changed only in case the actuator is electromechanical. In this case, indeed, it is sufficient to change the electric actuation signal sent by the electromechanical actuator of the piston 2.

The cylinder capacity V of the piston pump 1 can be changed through the actuator of the piston 2, regardless of whether it is electromechanical or mechanical.

In use, the change in the cylinder capacity V of the piston pump 1 can be carried out in the following operating modes:

i) by delaying the closing of the suction solenoid valve 7 (Late Intake Valve Closing, LIVC) and by synchronizing it with the movement of the piston 2. This means that the closing of the suction solenoid valve 7 is delayed in order to cause it to be in phase with the movement of the piston 2.

ii) by advancing the closing of the suction solenoid valve 7 (Early Intake Valve Closing, EIVC) and by synchronizing it with the movement of the piston 2. This means that the closing of the suction solenoid valve 7 is advanced in order to cause it to be in phase with the movement of the piston 2.

iii) controlling the suction solenoid valve 7 with a pulse-width modulation (PWM), with a variable duty cycle and by operating it in an asynchronous manner relative to the movement of the piston 2. In this case, the control of the suction solenoid valve 7 and the movement of the piston 2 do not coincide, namely they are off-phase.

iv) by advancing the closing (Early Delivery Valve Closing, EDVC) of the delivery solenoid valve 8.

v) combining the adjustment mode under point iv with one of the adjustment modes under points i, ii, or iii, as described above;

vi) by changing the frequency f of actuation of the piston 2 (only in case of an electromechanical pump) in combination with one of the adjustment modes under points i-vi, as described above.

The above-mentioned ways in which the cylinder capacity V of the piston pump 1 can be changed affect the pressurization energy, the mechanical stresses acting upon the piston 2 and the housing 3 and the mechanical stresses acting upon the solenoid valves 7 and 8.

Therefore, based on the demand for flow rate Q and on the pressure present in the liquid delivery circuit, the system establishes which one of the aforesaid phenomena to limit and, as a consequence, chooses the ways in which the suction solenoid valve 7 and the delivery solenoid valve 8 have to be activated.

The two solenoid valves 7 and 8 are installed in the piston pump 1 in such a way that the pressure present in the dead volume 4 helps the passage port 12 of the suction solenoid valve 7 open during the delivery stroke (as shown in FIG. 1) and the passage port 12 of the delivery solenoid valve 8 close during the suction stroke.

For a correct operation of the solenoid valves 7 and 8, the system clearly needs to know the exact position of the piston 2 inside the housing 3, so as to know in which phase the piston 2 is (namely, whether the piston 2 is in the suction phase or in the delivery phase).

The way in which position of the piston 2 is detected changes based on the type of actuation system of the piston pump 1. In other words, since the piston 2 is operated by an electromechanical or mechanical actuator, the way in which the position thereof is detected changes.

According to a first embodiment, the piston 2 is operated by an electromechanical actuator, namely by means of an electromagnet (not shown) and a spring countering the movement generated by the electromagnet; the delivery movement of piston 2 is normally caused by the electromagnet compressing the spring, whereas the suction movement of the piston 2 is normally caused by the spring after having turned off the electromagnet. In particular, the movement of the piston 2 is obtained by sending an electric signal to the electromagnet (namely, by supplying power to the electromagnet). Therefore, by so doing, the piston 2 moves towards its bottom dead centre PMI (and, hence, the liquid is delivered) or, alternatively, the piston 2 moves towards its top dead centre PMS (and, hence, the liquid is sucked in).

Figures 3A, 3B, 3C:
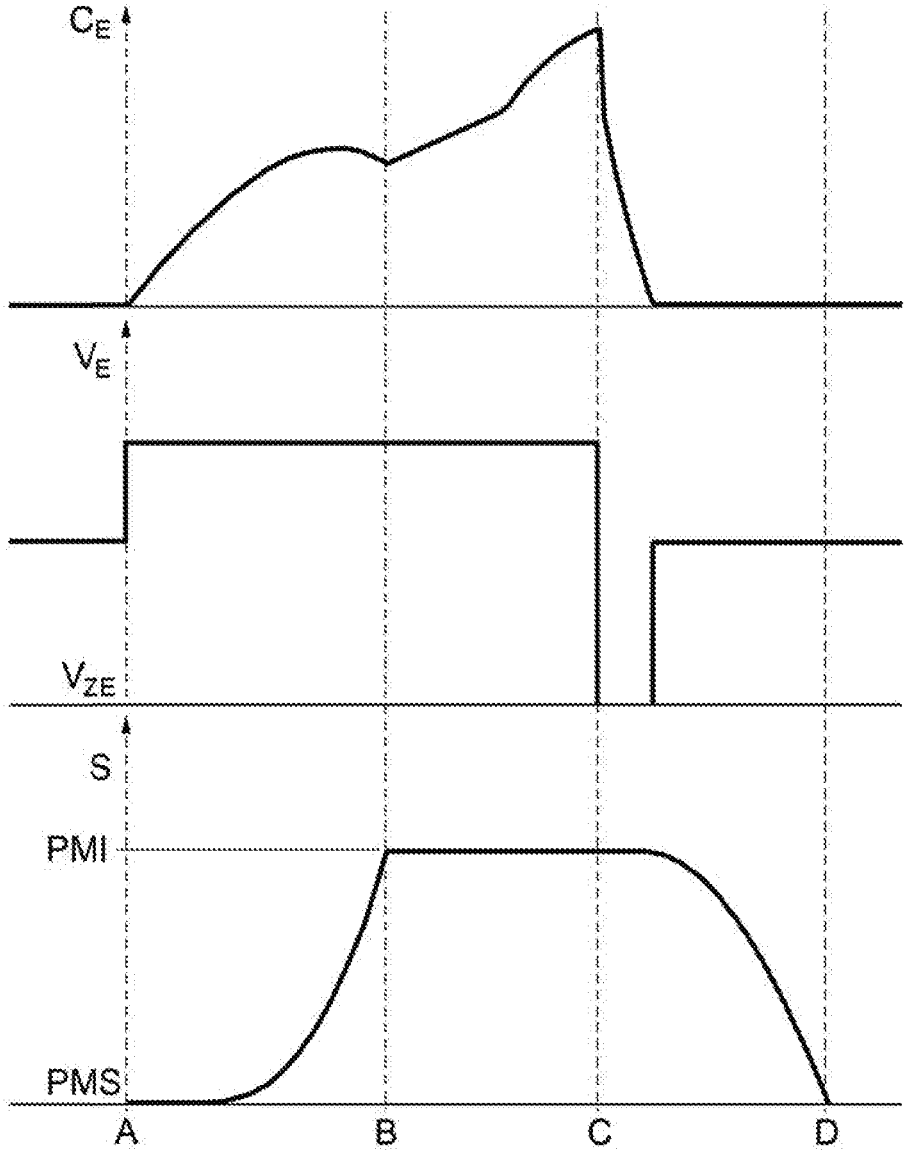
FIG. 3A relates to a first embodiment, in which the piston of the piston pump is operated by an electromagnet, and shows the time development of the current absorbed by an electromagnet operating the piston of the pump of FIGS. 1 and 2.
FIG. 3B relates to the first embodiment and shows the time development of the voltage of the electromagnet operating the piston of the pump of FIGS. 1 and 2.
FIG. 3C relates to the first embodiment and shows the time development of the movement of the piston of the pump of FIGS. 1 and 2.

FIGS. 3A-3C show the time development of the current $C_E$ absorbed by the electromagnet, the time development of the power supply voltage $V_E$ of the electromagnet and the time development of the movement S of the piston 2 as a function of the operating points A, B, C, D.

In operating point A, the electronic control unit ECU managing the piston pump 1 sends a voltage signal to the electromagnet, which operates and the piston 2, and the current $C_E$ starts increasing, as shown in FIG. 3A. In particular the signal sent will open the delivery valve 8 and close the suction valve 7. According to FIG. 3C, the movement S of the piston 2 clearly starts when the current $C_E$ reaches a value that is such as to overcome the elastic force generated by the spring. Therefore, the movement S of the piston 2 affects the development of the current $C_E$ absorbed by the electromagnet. On the other hand, according to FIG. 3B, the value of the power supply voltage $V_E$ remains constant. In point B, which also corresponds to the end of the delivery phase, the piston 2 reaches its bottom dead centre PMI. Therefore, from point A to point B, the suction solenoid valve 7 clearly needs to be closed, whereas the suction solenoid valve 8 clearly needs to be open, so that the liquid can be pumped into the delivery pipe and through the delivery solenoid valve 8. According to FIG. 3A, upon reaching of the bottom dead centre PMI, the development of the current $C_E$ absorbed by the electromagnet, which operates the piston 2, has a cusp; on the other hand, the power supply voltage $V_E$ still is constant (FIG. 3B). Therefore, taking a closer look to the development, in particular the one of the current $C_E$ absorbed by the electromagnet operating the piston 2, between point A and point B the position of the piston 2 inside the housing 3 can be established in a precise and unequivocal manner. In other words, when the development of the current $C_E$ absorbed by the electromagnet, which operates the piston 2, has a cusp, this means that the piston 2 has reached the bottom dead centre PMI.

Between point B and point C, the piston 2 is substantially still in the bottom dead centre PMI, whereas the current $C_E$ absorbed by the electromagnet increases, since the signal (i.e. the power supply voltage $V_E$) coming from the electronic control unit ECU is still active. In point C, the electronic control unit ECU deactivates the electromagnet operating the piston 2 and causes the power supply voltage $V_E$ to decrease up to a value $V_{ZE}$ so as to speed up the movement of the piston 2 from the bottom dead centre PMI to the top dead centre PMS. In other words, in point C, the current $C_E$ absorbed by the electromagnet quickly decreases, until it becomes substantially equal to zero (FIG. 3A); as a consequence, the power supply voltage of the electromagnet decreases as well (FIG. 3B). In this phase, the piston 2 is moved by the spring towards the top dead centre PMS with a delay, which is caused by the residual magnetism of the electromagnet operating the piston 2. Therefore, between point C and pint D there is the suction phase of the piston 2. From point C to point D, namely in the suction phase, the suction solenoid valve 7 clearly needs to be open and the suction solenoid valve 8 clearly needs to be closed, so that the liquid can be sucked into the dead volume 4 through the suction solenoid valve 7.

FIGS. 4A-4D respectively show the development of the current $C_P$ absorbed by the piston pump 1, of the power supply voltage $V_P$ of the piston pump 1, of the movement S of the piston 2 and of the control signal $V_V$ (i.e. of the voltage) of the electromagnetic valves 7 and 8.

Figures 4A, 4B, 4C, 4D:
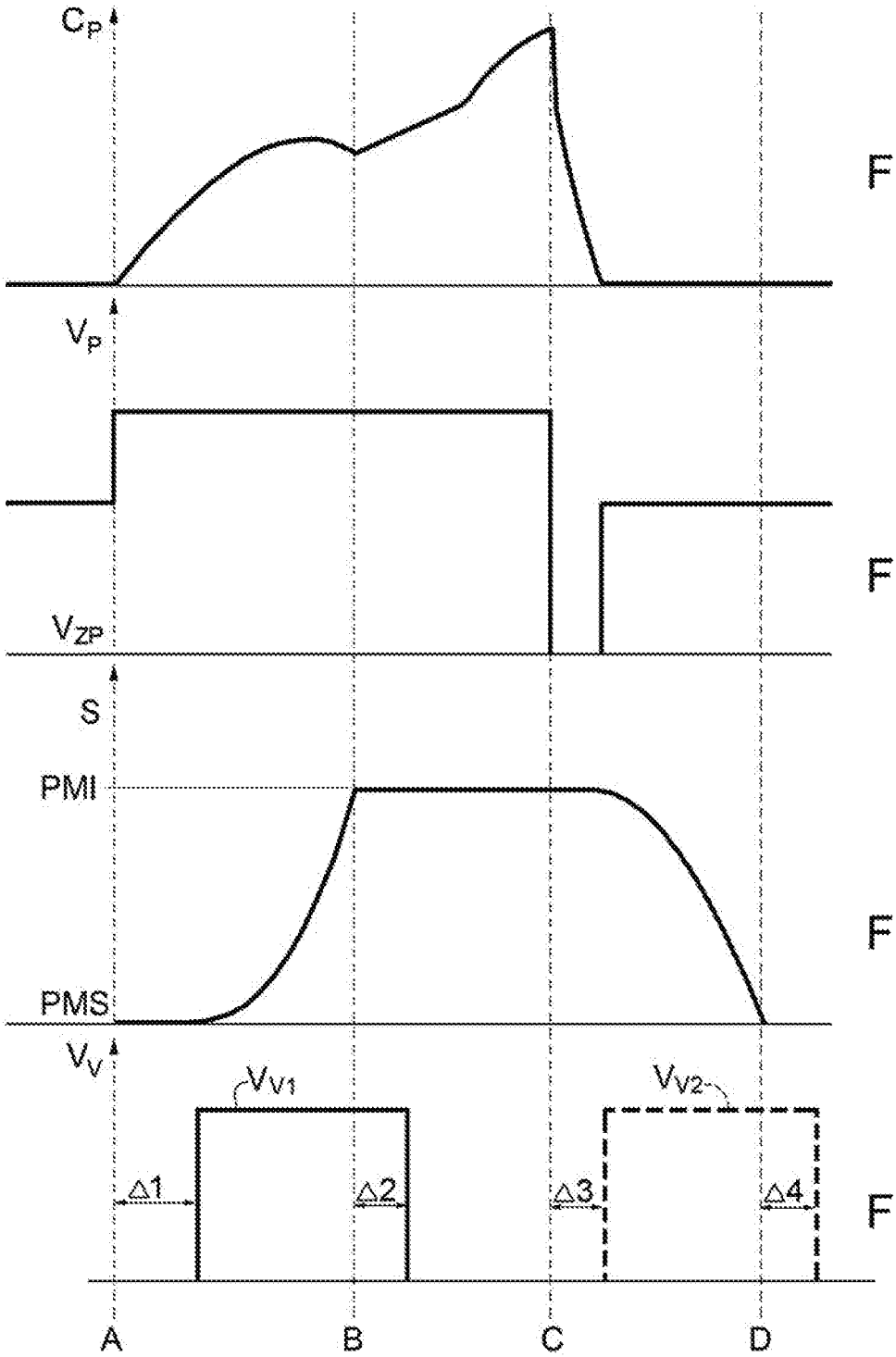
FIG. 4A relates to the first embodiment and shows the time development of the power supply current of the piston pump of FIGS. 1 and 2.
FIG. 4B relates to the first embodiment and shows the time development of the power supply voltage of the piston pump of FIGS. 1 and 2.
FIG. 4C relates to the first embodiment and shows the time development of the movement of the piston of the piston pump of FIGS. 1 and 2.
FIG. 4D relates to the first embodiment and shows the time development of the theoretical control signal of the electromagnetic valves of FIGS. 1 and 2.

In FIGS. 4A-4C, the time developments of the absorbed current $C_P$, of the power supply voltage $V_P$ and of the movement S of the piston 2 are substantially the same as the corresponding time developments shown in FIGS. 3A-3C.

Therefore, similarly, in operating point A, the electronic control unit ECU managing the piston pump 1 sends a voltage signal $V_P$ to the piston pump 1 and the current $C_P$ absorbed by the piston pump 1 starts increasing, as shown in FIG. 4A. In particular the signal sent will open the delivery solenoid valve 8 and close the suction solenoid valve 7. According to FIG. 4C, the movement S of the piston 2 clearly starts when the current $C_P$ absorbed by the piston pump 1 reaches a value that is such as to overcome the elastic force generated by the spring. Therefore, the movement S of the piston 2 affects the development of the current $C_P$ absorbed by the piston pump 1. On the other hand, according to FIG. 4B, the value of the power supply voltage $V_P$ of the piston pump 1 remains constant. In point B, which also corresponds to the end of the delivery phase, the piston 2 reaches its bottom dead centre PMI. Therefore, from point A to point B, the suction solenoid valve 7 clearly needs to be closed, whereas the suction solenoid valve 8 clearly needs to be open, so that the liquid can be pumped into the delivery pipe through the delivery solenoid valve 8. According to FIG. 4A, upon reaching of the bottom dead centre PMI, the development of the current $C_P$ absorbed by the piston pump 1 has a cusp; on the other hand, the power supply voltage $V_P$ of the piston pump 1 still is constant (FIG. 4B). Therefore, taking a closer look to the development, in particular the one of the current $C_P$ absorbed by the piston pump 1, between point A and point B the position of the piston 2 inside the housing 3 can be established in a precise and unequivocal manner. In other words, when the development of the current $C_P$ absorbed by the piston pump 1 has a cusp, this means that the piston 2 has reached the bottom dead centre PMI.

Between point B and point C, the piston 2 is substantially still in the bottom dead centre PMI, whereas the current $C_E$ absorbed by the electromagnet, which operates the piston 2, increases, since the signal (i.e. the power supply voltage $V_P$) coming from the electronic control unit ECU is still active. In point C, the electronic control unit ECU causes the power supply voltage $V_P$ of the piston pump 1 to decrease up to the value $V_{ZP}$ so as to speed up the movement of the piston 2 from the bottom dead centre PMI to the top dead centre PMS. In other words, in point C, the absorbed current $C_P$ quickly decreases, until it becomes substantially equal to zero (FIG. 4A); as a consequence, the power supply voltage of the electromagnet operating the piston 2 decreases as well (FIG. 4B). Between point C and pint D there is the suction phase of the piston 2. Therefore, from point C to point D, namely in the suction phase, the suction solenoid valve 7 clearly needs to be open and the suction solenoid valve 8 clearly needs to be closed, so that the liquid can be sucked into the dead volume 4 through the suction solenoid valve 7.

The electronic control unit ECU knows the voltage signal (i.e. the power supply voltage $V_P$) it sends to the piston pump 1 and can also read the respective value of the current $C_P$ absorbed by the piston pump 1. As a consequence, the electronic control unit ECU can control the delivery solenoid valve 8 and the suction solenoid valve 7 in a precise and exact manner.

FIG. 4D shows the development of the voltage signal $V_V$ sent to the solenoid valves 7 and 8 in order to open them. $V_{V1}$ indicates the development of the voltage signal sent to the delivery solenoid valve 8 in order to open and close it; on the other hand, $V_{V2}$ indicates the development of the voltage signal sent to the suction solenoid valve 7 in order to open and close it. In other words, FIG. 4D shows, with a continuous line, the development of the control signal $V_{V1}$ of the delivery solenoid valve 8; whereas the broken line shows the development of the control signal $V_{V2}$ of the suction solenoid valve 7.

According to FIG. 4D, the opening and closing of the suction solenoid valve 7 and of the delivery solenoid valve 8 are shifted relative to the theoretical instant indicated by points A, B, C and D. As a matter of fact, in order to take into account the actuation and movement delays of the piston 2 and of the solenoid valves 7 and 8, which depend on the dimensions of the piston 2, the mechanical features of the solenoid valves 7 and 8 and the electric features of the electromagnetic circuits both of the solenoid valves 7 and 8 and of the piston pump 1, the electronic control unit ECU applies at least a time offset Δ1, Δ2, Δ3 and Δ4. Therefore, the time offsets Δ1, Δ2, Δ3 and Δ4 are determined and taken into account by the electronic control unit ECU in order to optimize the actuation of the solenoid valves 7 and 8.

The electronic control unit ECU can advantageously adjust the time offsets Δ1, Δ2, Δ3 and Δ4 off-line, according to the nominal features of the piston pump 1, and subsequently optimize them on-line with multipliers or dividers, based on the signal of a pressure sensor arranged on the liquid delivery circuit. The pressure sensor allows the development of the power supply voltage $V_E$ or of the power supply current $C_E$ of the electromagnet of the piston 2 to be correlated with the pressure increase in the liquid delivery circuit.

The actual development of the opening of the solenoid valves 7 and 8 will clearly be affected also by mechanical and electric inertias. In order to adjust the different time offsets Δ1, Δ2, Δ3 and Δ4 off-line, the piston pump 1 can be tested with a nominal configuration, measuring the actual opening and closing of the solenoid valves 7 and 8 through an accelerometer or a microphone sensor, so as to correlate the value coming from these sensors with the electric signal given to the piston pump 1 with a nominal configuration. By so doing, actual (measured) values of the time offsets Δ1, Δ2, Δ3 and Δ4 can be found and stored at the end of the adjustment phase of the electronic control unit ECU.

In order to avoid the dispersions of the components due to the production, the different time offsets Δ1, Δ2, Δ3 and Δ4 can also be optimized on-line by the electronic control unit ECU using the signal coming from the pressure sensor. Indeed, starting from the value of the time offsets Δ1, Δ2, Δ3 and Δ4 obtained (adjusted) "off-line", they are changed so that the piston pump 1 always sends the highest liquid flow rate Q possible, which, hence, also corresponds to the highest pressure increase possible. In order to maximize the ratio between the signal and the noise, when in the delivery duct 6 of the piston pump 1 there are no drawings due to other utilities (such as, for example, the injector, the valves, etc.), this type of "on-line" acquisition can be carried out.

According to a different embodiment, which is not part of the invention, the piston 2 is operated by a mechanical actuator, i.e. by means of a cam (not shown). In this case, the movement of the piston 2 is caused by the rotation of the cam (not shown).

Figure 5A:
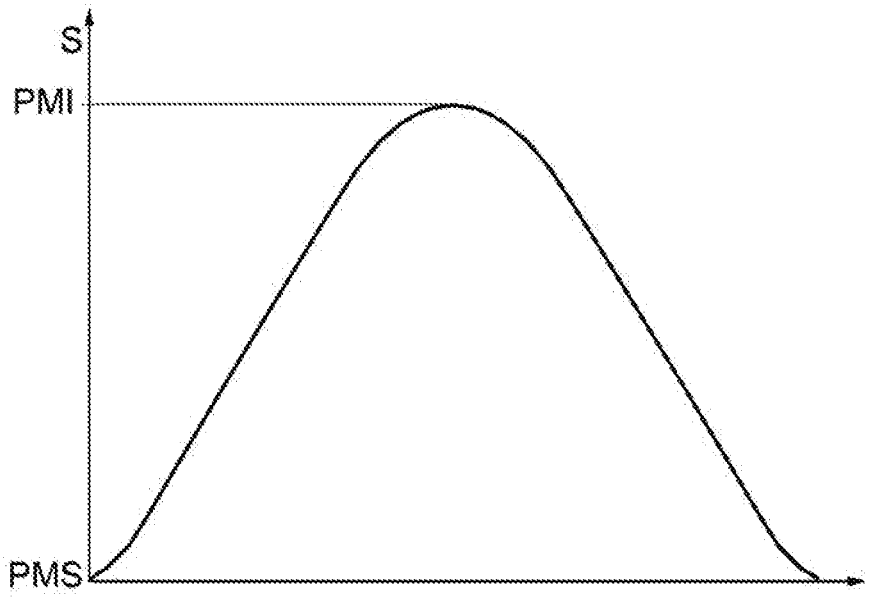
FIG. 5A relates to a second embodiment, which is not part of the invention and in which the piston of the piston pump is operated by a cam, and shows the movement of the piston as a function of the rotation angle of the cam.

FIG. 5A shows the movement S of the piston 2 as a function of the rotation angle of the cam. In the area of the maximum point, i.e. in the area of the middle line of the development, there is the reaching of the bottom dead centre (PMI), i.e. the end of the delivery phase and the beginning of the suction phase.

Figure 5B:
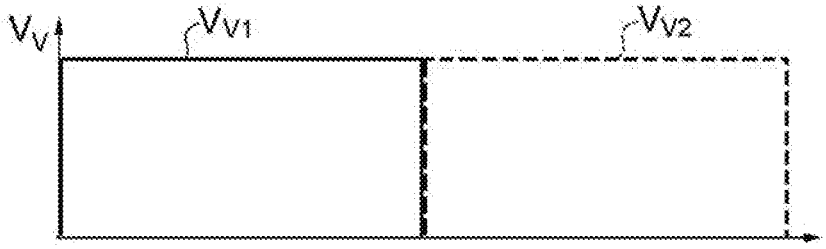
FIG. 5B relates to the second embodiment, which is not part of the invention, and shows the activation signal of the electromagnetic valves.

FIG. 5B, on the other hand, shows the development of the voltage signal $V_V$ sent to the solenoid valves 7 and 8 in order to open them. $V_{V1}$ indicates the development of the voltage signal sent to the delivery solenoid valve 8 in order to open and close it; on the other hand, $V_{V2}$ indicates the development of the voltage signal sent to the suction solenoid valve 7 in order to open and close it. In other words, FIG. 5B shows, with a continuous line, the development of the control signal $V_{V1}$ of the delivery solenoid valve 8; whereas the broken line shows the development of the control signal $V_{V2}$ of the suction solenoid valve 7.

Therefore, according to FIGS. 5A and 5B, during the movement S of the piston 2 from the top dead centre PMS to the bottom dead centre PMI, the delivery solenoid valve 8 is open, whereas the suction solenoid valve 7 is closed. On the contrary, during the movement S of the piston 2 from the bottom dead centre PMI to the top dead centre PMS, the delivery solenoid valve 8 is closed, whereas the suction solenoid valve 7 is open.

According to a possible embodiment which is not part of the invention, the used cam has three lobes and the duration of a cycle of the piston pump 1 is of 120°. However, what disclosed above also applies to cams having a different number of lobes.

According to a different embodiment, the position of the piston 2 can be measured with the aid of the phonic wheel present on the drive shaft of the vehicle. The phonic wheel allows users to determine with precision the stroke of the piston 2 and in which phase it is, namely whether it is in the suction stroke or in the delivery stroke. Therefore, the suction solenoid valve 7 and the delivery solenoid valve 8 are operated depending on the signal coming from the phonic wheel.

The piston pump 1 described above has a plurality of advantages.

The piston pump 1 disclosed above mainly allows its operating direction, namely the liquid feeding direction, to be reversed (from the main feeding direction $D_P$ to the secondary feeding direction $D_S$ and vice versa), without the addition of external reversing devices arranged on the outside of the piston pump 1. As a consequence, the piston pump 1 described above is more compact and easier to be manufactured.

Furthermore, the change in the cylinder capacity V of the piston pump 1 disclosed above leads to advantages in terms of energy, pressure oscillation in the delivery circuit as well as mechanical stresses acting upon the pump 1 itself. In particular the operating modes i-vi described above allow the pressurization energy to be limited (in particular, in cases i, ii, iii, vi and in the combination of cases iv and ii), the mechanical stresses acting upon the piston 2 and the housing 3 to be limited (in particular, in the combination of cases iv and ii) and the mechanical stresses acting upon the solenoid valves 7 and 8 to be limited (in particular, in cases i, ii and iii).

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

The invention claimed is:

1. A piston pump (1) for feeding a liquid in a vehicle; the piston pump (1) comprises:

at least one piston (2), which is configured to cyclically slide inside a housing (3) between a top dead centre (PMS) and a bottom dead centre (PMI);

a suction duct (5), which is configured to be connected, in use, to a tank;

a delivery duct (6), which is configured to be connected, in use, to a delivery line and along which the liquid is fed, in use, along a main feeding direction ($D_P$) of the piston pump (1), which is oriented from the suction duct (5) to the delivery duct (6);

a first solenoid valve (7), which is arranged in the suction duct (5);

a second solenoid valve (8), which is arranged in the delivery duct (6); and an electronic control unit (ECU) configured to operate the two solenoid valves (7, 8) so as to reverse the liquid feeding direction from the main feeding direction ($D_P$) to a secondary feeding direction ($D_S$) opposite the main feeding direction ($D_P$);

the piston (2) is operated by a electromechanical actuator comprising an electromagnet; and wherein the solenoid valves (7, 8) are configured to be operated by the electronic control unit (ECU) as a function of movement (S) of the piston (2) determined through a current (CE) absorbed by the electromagnet.

2. The piston pump (1) according to claim 1, wherein the electronic control unit (ECU) operates the two solenoid valves (7, 8) so as to adjust a cylinder capacity (V) of the piston pump (1) and wherein the solenoid valves (7, 8) are configured to be operated by the electronic control unit (ECU) as a function of movement (S) of the piston (2) determined through the current absorbed by the piston pump (1).

3. The piston pump (1) according to claim 1, wherein:

the solenoid valves (7, 8) are configured to be operated independently of one another;

in the main feeding direction ($D_P$), the liquid is sucked in through the first solenoid valve (7) and delivered through the second solenoid valve (8); and in the secondary feeding direction ($D_s$), the liquid is delivered through the first solenoid valve (7) and sucked in through the second solenoid valve (8).

4. The piston pump (1) according to claim 1, wherein each solenoid valve (7, 8) comprises an electromagnet (13), a rod (10), which is controlled by the electromagnet (13), a spring (9), which acts through the rod (10) upon a closing element (11), which at least partially engages or disengages a passage port (12) of the solenoid valve (7, 8), so as to allow the liquid to flow through the passage port (12) of the solenoid valve (7, 8) or prevent it from doing so.

5. The piston pump (1) according to claim 4, wherein the two springs (9*, 9**) of the two solenoid valves (7, 8) have different pre-loads.

6. A control method to control a piston pump (1) for feeding a liquid in a vehicle; the control method comprises the steps of:

providing a piston pump (1) comprising: at least one piston (2), which is configured to cyclically slide inside a housing (3) between a top dead centre (PMS) and a bottom dead centre (PMI), a suction duct (5), which is provided with a first solenoid valve (7), and a delivery duct (6), which is provided with a second solenoid valve (8); wherein, along a main feeding direction ($D_P$), the liquid is fed from the suction duct (5) to the delivery duct (6);

detecting the position of the piston (2) inside the housing (3), so as to know whether the piston (2) is in a suction phase or in a delivery phase; and operating the two solenoid valves (7, 8) independently of one another so as to reverse the liquid feeding direction from the main feeding direction ($D_P$) to a secondary feeding direction ($D_S$) opposite the main feeding direction ($D_P$); operating the piston with an electromechanical actuator comprising an electromagnet; and determining movement (S) of the piston by detecting development of a current (CE) absorbed by the electromagnet.

7. The control method according to claim 6 and comprising the further step of operating the two solenoid valves (7, 8) independently of one another so as to adjust a cylinder capacity (V) of the piston pump (1) and determining the movement (S) of the piston (2) by detecting development of the current absorbed by the piston pump (1).

8. The control method according to claim 6 and comprising the further step of operating the opening or the closing of the solenoid valves (7, 8) with at least one time offset (Δ1, Δ2, Δ3, Δ4) relative to a corresponding theoretical instant (A, B, C, D).

9. The control method according to claim 8 and comprising the further step of adjusting the at least one time offset (Δ1, Δ2, Δ3 and Δ4) "off-line" and subsequently optimizing them "on-line" based on a signal obtained from a pressure sensor arranged in a liquid delivery circuit.

10. The control method according to claim 6, wherein, in order to reverse the liquid feeding direction, the second solenoid valve (8) is commanded to be flowed through by the liquid sucked in and the first solenoid valve (7) is caused to be flowed through by the delivered liquid.

11. The control method according to claim 6 and comprising, in order to vary a cylinder capacity (V) of the piston pump (1), the further step of varying an actuation frequency (f) of the piston (2).

12. The control method according to claim 6 and comprising, in order to vary the cylinder capacity (V) of the pump, the further step of operating the two solenoid valves (7, 8) advancing or delaying closing of the first solenoid valve (7), which is flowed through by the liquid sucked in.

13. The control method according to claim 6 and comprising, in order to vary a cylinder capacity (V) of the pump, the further step of controlling the first solenoid valve (7), which is flowed through by the liquid sucked in, with a pulse width modulation having a variable duty cycle.

14. The control method according to claim 6 and comprising, in order to vary the cylinder capacity (V) of the pump, the further step of advancing closing of the second solenoid valve (8), which is flowed through by the delivered liquid.

* * * * *